US005733229A

United States Patent [19]

Dalebout et al.

[11] Patent Number: 5,733,229

[45] Date of Patent: Mar. 31, 1998

[54] EXERCISE APPARATUS USING BODY WEIGHT RESISTANCE

[75] Inventors: William T. Dalebout; Steven J. Beutler, both of Logan, Utah

[73] Assignee: Icon Health & Fitness, Inc., Logan, Utah

[21] Appl. No.: 382,343

[22] Filed: Feb. 1, 1995

[51] Int. Cl.[6] ..... A63B 21/068

[52] U.S. Cl. ..... 482/96; 482/135; 482/136; 482/138; 482/139

[58] Field of Search ..... 482/92–96, 133–139, 482/142, 72, 97, 100, 101

[56] References Cited

U.S. PATENT DOCUMENTS

| | | | |
|---|---|---|---|
| Re. 34,577 | 4/1994 | Habing et al. . | |
| 104,973 | 7/1870 | Mann . | |
| 248,121 | 10/1881 | Tuttle . | |
| D. 324,710 | 3/1992 | Habing . | |
| D. 341,176 | 11/1993 | Habing et al. . | |
| 2,924,456 | 2/1960 | Miller . | |
| 3,380,737 | 4/1968 | Elia et al. . | |
| 3,446,503 | 5/1969 | Lawton . | |
| 3,708,166 | 1/1973 | Annas . | |
| 3,858,873 | 1/1975 | Jones . | |
| 4,176,836 | 12/1979 | Coyle . | |
| 4,300,760 | 11/1981 | Bobroff . | |
| 4,391,440 | 7/1983 | Berger . | |
| 4,456,246 | 6/1984 | Szabo . | |
| 4,489,936 | 12/1984 | Dal Monte . | |
| 4,502,682 | 3/1985 | Miller . | |
| 4,627,616 | 12/1986 | Kauffman . | |
| 4,632,390 | 12/1986 | Richey . | |
| 4,634,118 | 1/1987 | Jensen . | |
| 4,641,833 | 2/1987 | Trethewey . | |
| 4,655,448 | 4/1987 | Harder . | |
| 4,700,946 | 10/1987 | Breunig . | |
| 4,753,437 | 6/1988 | Lapcevic . | |
| 4,793,608 | 12/1988 | Mahnke et al. | 482/98 |
| 4,809,972 | 3/1989 | Rasmussen et al. . | |
| 4,826,157 | 5/1989 | Fitzpatrick . | |
| 4,840,373 | 6/1989 | Maag | 482/136 |
| 4,844,456 | 7/1989 | Habing et al. . | |

(List continued on next page.)

FOREIGN PATENT DOCUMENTS

| | | | |
|---|---|---|---|
| 653426 | 3/1993 | Australia | 482/92 |
| 9300435 | 4/1994 | Brazil . | |
| 474691 | 6/1951 | Canada . | |
| 2075331 | 2/1994 | Canada . | |
| 445629 | 11/1912 | France . | |
| 2612406 | 9/1988 | France | 482/100 |

(List continued on next page.)

OTHER PUBLICATIONS

Swivel Grip, advertisement received in PTO Jun. 9, 1994, 6 pages.
The Gravity Edge Assembly Instructions.
The Gravity Edge Owner's Manual.
The Gravity Edge Advertising Brochure.
The Gravity Edge Advertising Slick.
Exercise for Men Only Advertising Page; "Home Gyms, Benches & Lifestyle".
Expert Advertising Brochure.
Health Rider Advertising Brochure.

(List continued on next page.)

*Primary Examiner*—Stephen R. Crow
*Assistant Examiner*—Victor K. Hwang
*Attorney, Agent, or Firm*—Trask, Britt & Rossa

[57] ABSTRACT

An exercise machine has a frame that has a base with an upright member. The upright member is formed to have a race to receive wheels to interconnect a second frame to the upright member. A cable and pulley structure interconnects exercise structures to cause movement of the second frame relative to the first frame. A user is positioned on a seat connected to the second frame to resist movement of the second frame relative to the first frame. A butterfly structure is provided that has a mechanical linkage to interconnect the link arms to a butterfly lever rotatably connected to deflect the cable of an associated cable arrangement.

30 Claims, 13 Drawing Sheets

U.S. PATENT DOCUMENTS

| | | | |
|---|---|---|---|
| 4,846,458 | 7/1989 | Potts | 482/41 |
| 4,854,578 | 8/1989 | Fulks | 482/137 |
| 4,902,007 | 2/1990 | Ferrari . | |
| 4,911,438 | 3/1990 | Van Straaten . | |
| 4,949,958 | 8/1990 | Richey . | |
| 4,964,632 | 10/1990 | Rockwell . | |
| 5,037,090 | 8/1991 | Fitzpatrick . | |
| 5,040,785 | 8/1991 | Charnitski | 482/95 |
| 5,085,430 | 2/1992 | Habing . | |
| 5,106,079 | 4/1992 | Escobedo et al. . | |
| 5,156,650 | 10/1992 | Bals . | |
| 5,169,362 | 12/1992 | Schwartz . | |
| 5,178,599 | 1/1993 | Scott . | |
| 5,190,513 | 3/1993 | Habing et al. . | |
| 5,194,059 | 3/1993 | Wu . | |
| 5,199,935 | 4/1993 | Gibson et al. . | |
| 5,201,694 | 4/1993 | Zappel . | |
| 5,221,245 | 6/1993 | Yeh . | |
| 5,222,928 | 6/1993 | Yacullo . | |
| 5,230,680 | 7/1993 | Wu . | |
| 5,236,406 | 8/1993 | Webber . | |
| 5,242,342 | 9/1993 | Silverman . | |
| 5,254,067 | 10/1993 | Habing et al. . | |
| 5,261,865 | 11/1993 | Trainor . | |
| 5,263,913 | 11/1993 | Boren . | |
| 5,263,915 | 11/1993 | Habing . | |
| 5,290,214 | 3/1994 | Chen . | |
| 5,299,993 | 4/1994 | Habing . | |
| 5,299,997 | 4/1994 | Chen . | |
| 5,308,304 | 5/1994 | Habing . | |
| 5,312,313 | 5/1994 | Holmes et al. | 482/95 |
| 5,322,489 | 6/1994 | Webb et al. | 482/137 |
| 5,330,405 | 7/1994 | Habing et al. . | |
| 5,334,120 | 8/1994 | Rasmussen . | |
| 5,336,148 | 8/1994 | Ish, III | 482/137 |
| 5,346,447 | 9/1994 | Stearns . | |
| 5,352,171 | 10/1994 | Lin . | |
| 5,354,252 | 10/1994 | Habing . | |
| 5,356,358 | 10/1994 | Chen . | |
| 5,366,428 | 11/1994 | Liao . | |
| 5,366,432 | 11/1994 | Habing et al. . | |
| 5,374,230 | 12/1994 | Bonnaime | 482/138 |
| 5,407,405 | 4/1995 | Oren | 482/139 |
| 5,492,518 | 2/1996 | Measom | 482/96 |
| 5,554,086 | 9/1996 | Habing et al. | 482/96 |

FOREIGN PATENT DOCUMENTS

| | | | |
|---|---|---|---|
| 121354 | 2/1931 | Germany . | |
| 2528762A | 1/1977 | Germany . | |
| 2942675A1 | 5/1981 | Germany . | |
| 59-139279 | 8/1984 | Japan . | |
| 6245720 | 2/1985 | Japan . | |
| 234622 | 6/1988 | Japan . | |
| 234177 | 2/1990 | Japan . | |
| 2206479 | 8/1990 | Japan . | |
| 3139369 | 6/1991 | Japan . | |
| 1646557 A1 | 5/1991 | U.S.S.R. | 482/96 |
| 1674870 | 9/1991 | U.S.S.R. . | |
| 1674871 | 9/1991 | U.S.S.R. . | |
| 1674872 | 9/1991 | U.S.S.R. . | |
| 1674873 | 9/1991 | U.S.S.R. . | |
| 1674874 | 9/1991 | U.S.S.R. . | |
| 1674875 | 9/1991 | U.S.S.R. . | |
| 1683791 A1 | 10/1991 | U.S.S.R. | 482/96 |
| 2110548 | 6/1983 | United Kingdom . | |
| 2133705 | 8/1984 | United Kingdom . | |
| 2133706 | 8/1984 | United Kingdom . | |
| 9218204 | 10/1992 | WIPO . | |
| 92/19326 | 11/1992 | WIPO | 482/102 |
| 9325283 | 12/1993 | WIPO . | |

OTHER PUBLICATIONS

JCPenney Advertisement for Bodylift CTX, Pro–form Treadmill, and Alpine Tracker (1991).
Pacific Fitness Bodylift 1000 Brochure (1994).
Pacific Fitness Bodylift 1000 Advertisement, The Home Fitness Buyers Guide, Winter 1994.
Pro–Form Advertisement for the Bodylift, VKR, and Stepper.
Pro–Form Edge 4001 Advertising Brochure (1993).
Pro–Form Edge 4001 Explanatory Brochure.
Pro–Form Edge 2001 Advertising Brochure.
Pro–Form Edge 2001 Features and Benefits Brochure (1991–92).
Pro–Form Bodylift Owner's Manual (1994).
Pro–Form Bodylift Exercise Guide (1994).
Pro–Form Bodylift Brochure.
Stearns Bench Brochure (Sep. 1992).
Total Gym Advertisement.
WESLO Body Focus Brochure (Mar. 16, 1994).

426
422
420
410
416
412
414
424
380
378
418
372

428
324
372
370

432
430
410
372

434

EXERCISE APPARATUS USING BODY WEIGHT RESISTANCE

BACKGROUND OF THE INVENTION

1. Field of the Invention

This invention relates to exercise machines and more particularly to exercise machines in which resistance to the performance of the exercises is provided by the weight of the body of the user and to exercise machines of the type that employ a butterfly-type exercise structure for operation by a user positioned on the machine.

2. State of the Art

Exercise machines that use the weight of the body of the user to resist movement of operational structure to in return provide resistance to the movement of that structure and in turn provide exercise to the user are known. U.S. Pat. No. 104,973 (Mann) and U.S. Pat. No. 248,121 (Tuttle) illustrate exercise devices in which the weight of a user is positioned to provide the resistance to exercise. More recently, the GRAVITY EDGE™ machine offered by SLM Fitness of 205th Avenue, New York, N.Y. 10010 is a commercially available unit that may be operated in a variety of configurations. In each of the different configurations the weight of the user provides the resistance to movement of, for example, a press arm to in turn provide an exercise benefit to the user.

Other exercise machines are known that employ the weight of the user to resist movement. For example, U.S. Pat. No. 5,334,120 (Rasmussen) shows a sled device in which the resistance to movement of operational structure is provided by the weight of the structure and the weight of the user. U.S. Pat. No. 5,330,405 (Habing, et al.) illustrates a machine which is presently being commercially offered by Pacific Fitness Corporation of Cypress, Calif. The Habing, et al. patent shows a subframe positioned relative to a mainframe. Articulated levers interconnect the mainframe and the subframe. Upon movement of a lever, interconnecting cables move the subframe relative to the main frame in the performance of exercise. U.S. Pat. No. 5,201,694 shows a device in which springs support part of the weight of a user on a seat movable along a column by rollers.

Other body resistance structures include the ProAct 500 offered by PPS Corporation of Bellingham, Wash. In addition, there are a variety of rowing machine apparatus that employ body weight to resist movement of the rower.

The machine illustrated in Habing, et al. patent of Pacific Fitness has a butterfly station interconnected by cables to resist movement by the user's body weight. U.S. Pat. No. 5,290,214 (Chen) also shows a type of butterfly structure suitable for a user on a multigym type machine.

A more simplified configuration of a multigym structure is desired to facilitate ease in operation and to minimize cost in manufacture. Further, a simplified butterfly structure for use with a multigym machine is also desired to reduce cost and facilitate use.

SUMMARY

An exercise machine has a first frame with a base for positioning on a support surface. An upright member is secured to the base to extend upwardly therefrom. A second frame is positioned proximate the upright member to move relative thereto and therealong. Guide means interconnect the second frame and the upright member for guiding the second frame in its movement relative to the upright member.

The exercise machine also includes user support means secured to the second frame to support a user thereon during the performance of exercise to provide the resistance in performing exercise. The exercise machine also includes operation means connected to one of the first frame and the second frame in position for operation by the user positioned on the user support means to perform exercises. Linking means interconnects the operation means to the first frame and also to the second frame. Movement of the operation means by the user urges movement of the second frame upward relative to and along the upright member through operation of the linking means so that the user's weight positioned on the user support resists movement of the operation means.

The guide means preferably is a first guide assembly and a second guide assembly spaced from the first guide assembly. The first guide assembly is desirably a first trolley with a first roller means rotatably attached thereto. The first roller means guides the second frame in moving relative to and along the upright member. A second guide assembly is also provided and includes a second trolley with a second roller means attached thereto. A second roller means guides the second frame in moving relative to and along the upright member.

The upright member desirably includes a track configured for contact by the first roller means and the second roller means. More preferably, the first roller means and the second roller means are each a pair of spaced apart wheels which are sized to be movably received in a first race and a second race formed in the track.

It is preferred that the second frame include an upright in general alignment and spaced from the upright member of the first frame. The user support means is a seat attached to the upright in position to receive and support a sitting user thereon. The user support means also preferably includes a backrest attached to the upright above the seat.

In a preferred arrangement the operation means includes a press arm having a left member positioned for movement by the left hand of the user seated on the seat and a right member positioned for movement by the left hand of the user seated on the seat. The operation means may also include extension structure positioned proximate the seat for operation by a user seated thereon. The operation means may also include a butterfly exercise structure positioned for operation by a user on the seat.

The operation means may also include overhead structure for performing overhead exercises in which an overhead bar is pulled downwardly from above the user. The operation means of the exercise machine may also include a lower pull mechanism for operation by the user positioned on the seat to perform, for example, curl exercises.

In one configuration, the press arm of the operation means includes a left handle movably attached to the left member and a right handle movably attached to the right member each rotatably positioned and secured proximate the upper end of the left handle of the left member and the upper end of the right handle of the right member, respectively. As the left member and right member are moved, the left handle and right handle each rotate about the left member and right member respectively so the user's hands and arms may follow a desired path in the performance of selected exercises.

In a more preferred arrangement, the butterfly structure includes a left butterfly arm and a right butterfly arm each rotatably attached to the second frame for rotation about a generally upright axis. The butterfly structure includes a butterfly lever arm rotatably connected to the second frame to rotate toward and away from the second frame. The butterfly lever arm is also secured to the linking means and has connecting structure to interconnect to the left butterfly arm and the right butterfly arm. Desirably the butterfly lever arm has a proximal end positioned proximate the proximal ends of the left butterfly arm and the right butterfly arm. The proximal ends of the left butterfly arm and the right butterfly arm each have an extension to contact a guide surface which is secured to the proximal end of the butterfly lever arm. As the left and right butterfly arms are operated, the extensions of the left butterfly arm and the right butterfly arm contact the guide surface and urge the butterfly lever arm to rotate about its axis in turn cause its distal end to move relative to the second frame and in turn operate the linkage means.

In an alternate embodiment, the linking means includes a plurality of second guides positioned on the second frame. A first guide is connected to the first frame. A cable is trained about the second guides and the first guide so that upon operation of the operation means the second frame moves relative to the upright member. The butterfly lever arm preferably may have a butterfly guide on its distal end. The cable is trained over the butterfly guide and is displaced upon operation of the butterfly arms.

In yet a preferred arrangement a lever member is rotatably connected to the upright member of the first frame. The first guide is associated with the lever member to move therewith. An arm member is connected to the upright member and is movable between a first position and second position. The arm member has means to secure the lever member in a first position and a second position to vary the resistance to movement of the operation means.

The lever member may also be connected to the second frame to rotate about an axle. The lever member has a first end positioned away from the axle with the first guide positioned thereon. A second end is spaced away from the axle for interconnection to an adjustment arm. The adjustment arm is connected to the first frame. The cable is trained about the first guide and the other guides to provide resistance to movement of the second frame relative to the first frame.

An alternate exercise machine includes a frame with user support means secured to the frame. The structure to support a user thereon is attached to the frame to support a user during the performance of exercise. A left butterfly arm is positioned proximate the user for operation by the user positioned on the user support means. The left butterfly arm and the right butterfly arm are preferably symmetrically positioned and are operable to perform butterfly exercises. A butterfly lever is rotatably connected to the frame. The butterfly lever has a proximal end positioned proximate the left butterfly arm and the right butterfly arm. The butterfly lever also has a distal end movable toward and away from the frame. Linkage links the proximal ends of the butterfly lever to the left butterfly arm and the right butterfly arm so that upon movement of either the left butterfly arm or the right butterfly arm, the proximal end of the butterfly lever moves and the distal end of the butterfly arm moves. Resistance means are connected proximate the distal end of the butterfly lever to resist movement thereof.

In the preferred configuration of the alternate machine, linking means has a guide surface associated with the proximal end of the butterfly lever. The left butterfly arm has an extension at its proximal end for contacting the guide surface. Similarly, the right butterfly arm has an extension at its proximal end for contacting the guide surface. Preferably the guide surface includes a left cylinder and a right cylinder spaced from the left cylinder. The left cylinder is positioned for contact with the extension of the left butterfly arm. Similarly, the right cylinder is positioned for contact with the extension of the right butterfly arm.

BRIEF DESCRIPTION OF THE DRAWINGS

In the drawings which illustrate what is presently regarded as preferred embodiments of the invention.

DETAILED DESCRIPTION OF THE ILLUSTRATED EMBODIMENT

Figure 1:
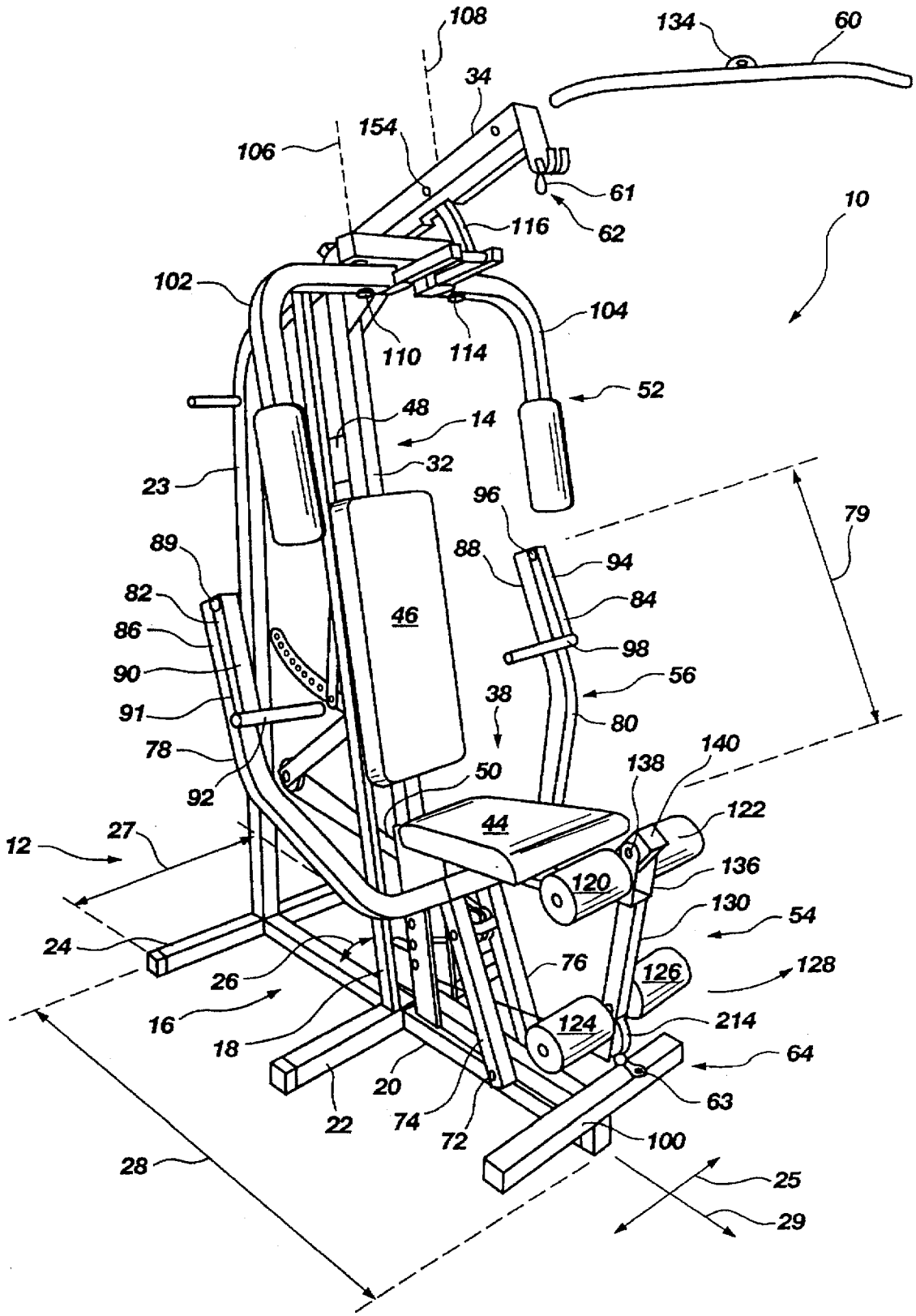
FIG. 1 is a perspective view of an exercise machine of the invention having a first frame and a second frame positioned for movement relative to the first frame.

The exercise machine 10 shown in FIG. 1 has a first frame generally identified as 12 and a second frame 14 positioned for movement relative to the first frame 12. More specifically, the first frame 12 has a base 16 with an upright member 18 secured thereto to extend upwardly therefrom. The base 16 has a central member 20 with a cross foot 22 spaced away from a rear cross foot 24. The cross feet 22 and 24 have a width 27 selected to provide stable support to the exercise machine 10 when positioned on a support surface. Similarly, the length 28 of the central member 20 is selected to provide stable support to the exercise machine 10 when positioned on a support surface.

Other configurations of the base 16 in which the central member 20 and cross feet 22 and 24 are reconfigured may be selected as desired. The base 16 is configured principally to provide stable support in both a longitudinal direction 29 as well as a transverse direction 25.

The upright member 18 as hereinbefore noted extends upwardly from the base 16. As better seen in FIG. 2, the upright member 18 is positioned at an angle 26 relative to the base 16 and more particularly the central member 20. The angle 26 is here shown to be about 85 degrees. Other angles may be suitable or used as desired and would be acceptable so long as the second frame 14 is movable relative to the first frame 12 in the performance of exercises. It may also be noted that the upright member 18 is here shown to be an essentially straight tubular member. Other configurations may be used including slightly arcuate arrangements in order to provide for alternate resistance profiles during the performance of exercises. The first frame 12 as here shown also includes a rear support 23 which extends upwardly and with a cross piece 30 provides support to the upright member 18. As shown the rear support 23 is unitarily formed with cross piece 30. Other configurations of rear support 23 and cross piece 30 may be selected as desired to provide additional support to the upright member 18.

The second frame 14 is here shown having an upright 32 with an upper cantilever member 34 secured at its upward end 36 to extend away therefrom. A user support structure 38 is also attached to the upright 32 by a bracket 40 interconnected to a user support extension 42. A seat 44 is attached to the user support extension 42 to support a user performing exercises on the exercise machine 10. The user support structure 38 also includes a back 46 connected to the upright 32 of the second frame 14.

Guide means are provided to guide the second frame 14 in movement relative to the first frame 12 and more specifically along the upright member 18. The guide means as shown in FIG. 1 has a first guide assembly 48 and a second guide assembly 50. As will be discussed more fully herein after, the first guide assembly 48 and the second guide assembly 50 include a trolley or carriage with rollers to interconnect to a track.

The exercise machine of FIG. 1 also includes operation means which are connected selectively one of to the first frame 12 and the second frame 14 in position for operation by a user positioned on the user support means. The operation means may include a butterfly structure 52, an extension or leg extensions structure 54, and a press arm structure 56.

The press arm structure 56 is here shown rotatably attached to a bottom support 58 which is directly secured to the upright 32 of the second frame 14. Alternately, the press arm structure 56 may be rotatably secured to the central member 20 of the base 16 if desired in selective applications. However, the press arm structure 56 is preferably secured to the second frame 14 and more particularly to the bottom support 58 for a movement with the second frame 14 upon operation of operation means by a user positioned on the seat 44.

An exercise bar 60 is also shown for attachment to a first hook 61 to function as an overhead pull structure 62 and in turn as operation means. Similarly, the bar 60 may be used for connection to a second hook 63 to form a curl structure 64 to function as operation means of the exercise machine 10.

As better seen in FIGS. 2, 3, 4 and 6, a linking means is used to link the operation means to the first frame 12 and second frame 14 for causing movement of the second frame 14 relative to the first frame 12 and more specifically to the upright member 18 for the performance of exercises. As here shown the linkage means includes a cable 118 trained about a second guide such as upper guide 68 and a first guide 70 as more fully discussed hereinafter.

Referring back to FIG. 1, the press arm structure 56 is here shown to be rotated around an axle 72 which passes through the bottom support 58 which in turn is attached to the upright 32 of the second frame 14 by any suitable means (e.g., welding, bolting). A left brace 76 and a right brace 74 each extend upwardly from the axle 72 for connection to a U-shaped member having a right member 78 and a left member 80 both of which are sized in height 79 for positioning proximate the hands of a user seated on the seat 44 of the user support 38.

A right handle 82 and a left handle 84 are connected to the distal ends 86 and 88 of the right member 78 and the left member 80, respectively. The right handle 82 comprises a right extension member 90 which is rotatably connected to a right shaft, pin or axle 89. A right cross handle 92 is attached to the distal end 91 of the right extension member 90.

For the left member 80, the handle 84 similarly has a left extension member 94 rotatably connected about a left axle 96 positioned proximate to distal end 88 of the left member 80. A left cross handle 98 is attached to the extension member by welding, bolts or other suitable means. As can be seen, a user positioned on the seat 44 may grasp the cross handles 92 and 98 and operate them to urge the left member 80 and the right member 78 from the at rest position (FIG. 2) outwardly from the user to a second or displaced position (FIG. 3).

Figure 3:
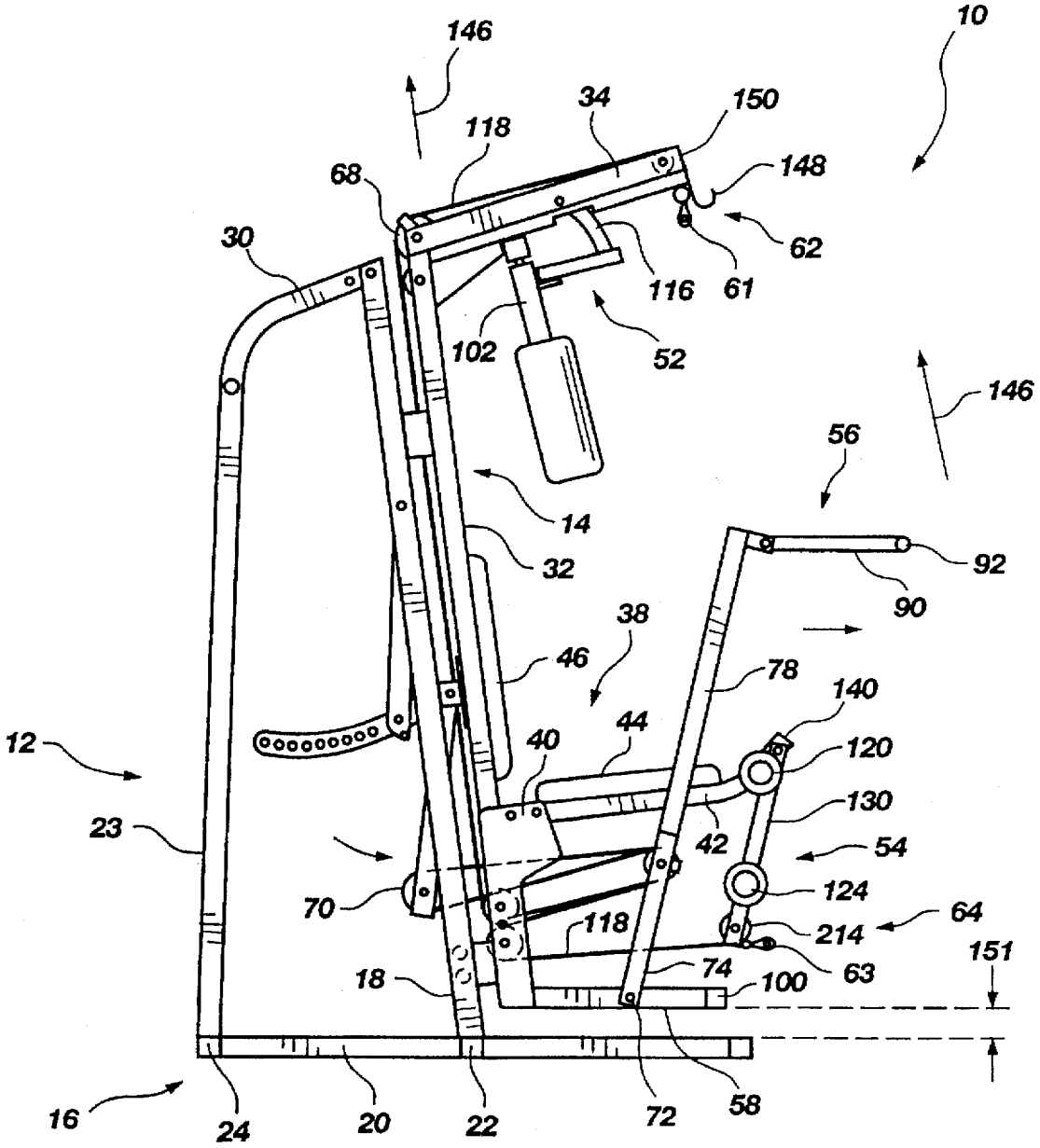
FIG. 3 is a side view of the exercise machine of FIG. 1 with press arm structure in a displaced position.

As better seen in FIG. 3, the second frame 14 moves upwardly and along the upright member 18 against the weight of the user positioned on the seat 44. The user may place the user's feet on a cross member 100 secured to the distal end of the bottom support 58. That is, the user's tendency to place his or her feet on the support surface is reduced by providing the cross member 100 for the user's feet during the performance of exercises.

In FIG. 1, the butterfly structure 52 is here shown comprised of a right butterfly arm 102 and a left butterfly arm 104. The right butterfly arm 102 rotates about a substantially upright right axis 106 and more particularly around right axle 110. Similarly, the left butterfly arm 104 rotates about a substantially upright left axis 108 and more particularly around left axle 114. The butterfly structure 52 includes interconnecting structure linked to a butterfly lever member 116 which in turn operates the linking means and more specifically the cable 118 as more fully discussed herein after.

The extension or leg extension structure 54 is shown in FIG. 1. It includes a right upper cushion 120 and a left upper cushion 122. The legs of a user positioned on seat 44 extend over the cushions 120 and 122. The user then flexes the knees to hook the top of the foot over a right lower cushion 124 and a left lower cushion 126 which are connected at a spaced distance from the upper cushions 120 and 122 to extension 130. Extension 130 is rotatably connected by a yoke 136 to rotate about an extension axle 138 associated with the distal end 140 of the support extension 42 interconnected to the upright 32 by the bracket 40.

The user operates the extension structure 54 by moving the lower cushions 124 and 126 in an outward direction 128 to exercise desired muscles. In turn, the cable 118 is extended urging the second frame 14 in an upward direction 146 relative to the upright member 18 of the first frame 12.

FIG. 1 also depicts the curl structure 64 which includes the second hook 63 positioned for interconnection to a corresponding hole or eye 134 associated with the bar 60. Upon hooking the hole or eye 134 to the second hook 63, the user may operate the bar 60 by pulling it upwards towards the user to perform a curl type exercise. The cable 118 is in turn displaced to urge the second frame 14 upward relative to the upright member 18.

Also shown in FIG. 3 is the overhead structure 62 here also comprised of the first hook 61 for interconnection to the hole or eye 134 associated with the bar 60. That is, the first hook 61 and hole or eye 134 are sized to be interconnected. In turn, the user may pull downward upon the bar 60 while positioned on the seat 44. The cable 118 thereby extends downwardly causing relative movement of the second frame 14 in an upward direction 146 relative to the upright member 18. It may be noted that a receptacle 148 is provided proximate the distal end 150 of the upper cantilever member 34 to retain the bar 60.

Figure 2:
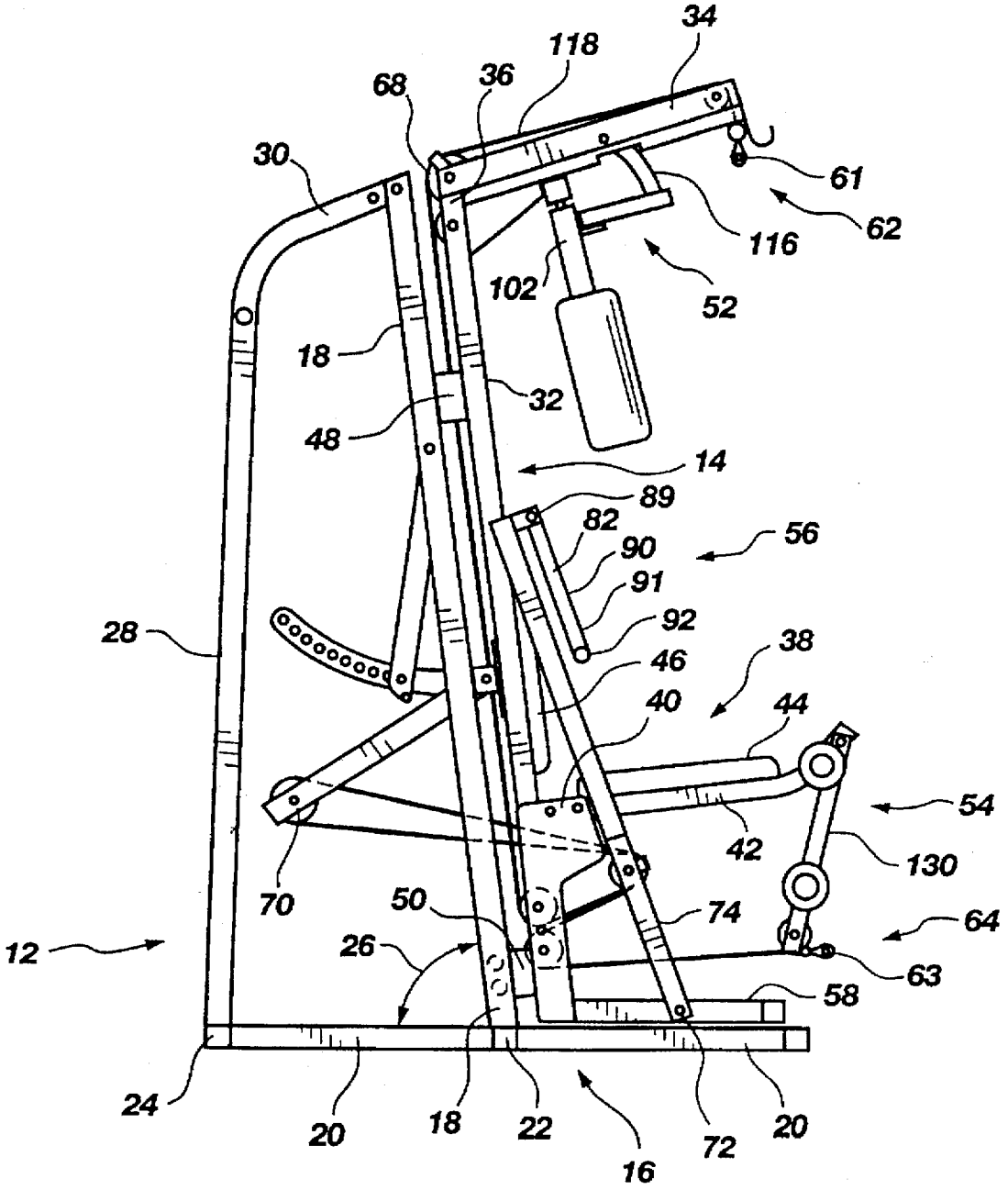
FIG. 2 is a side view of the exercise machine of FIG. 1 with its operational structure in an at rest position.

As herein before noted, FIG. 1 shows the press arm structure 56 in an at rest position. FIG. 2 shows the press arm structure 56 in an operative position displaced away from the at rest position shown in FIG. 1. More particularly, the user will place the user's hands on the right cross handle 92 as well as the left cross handle 98 to urge the press arm and more specifically the right member 78 and the left member 80 outwardly as generally shown in FIG. 3. In turn, it may be noted that the second frame 14 is displaced upwardly a distance 151. Displacement is, of course, resisted by gravity urging the user's body positioned on the seat 44 in a downward direction.

Figure 4:
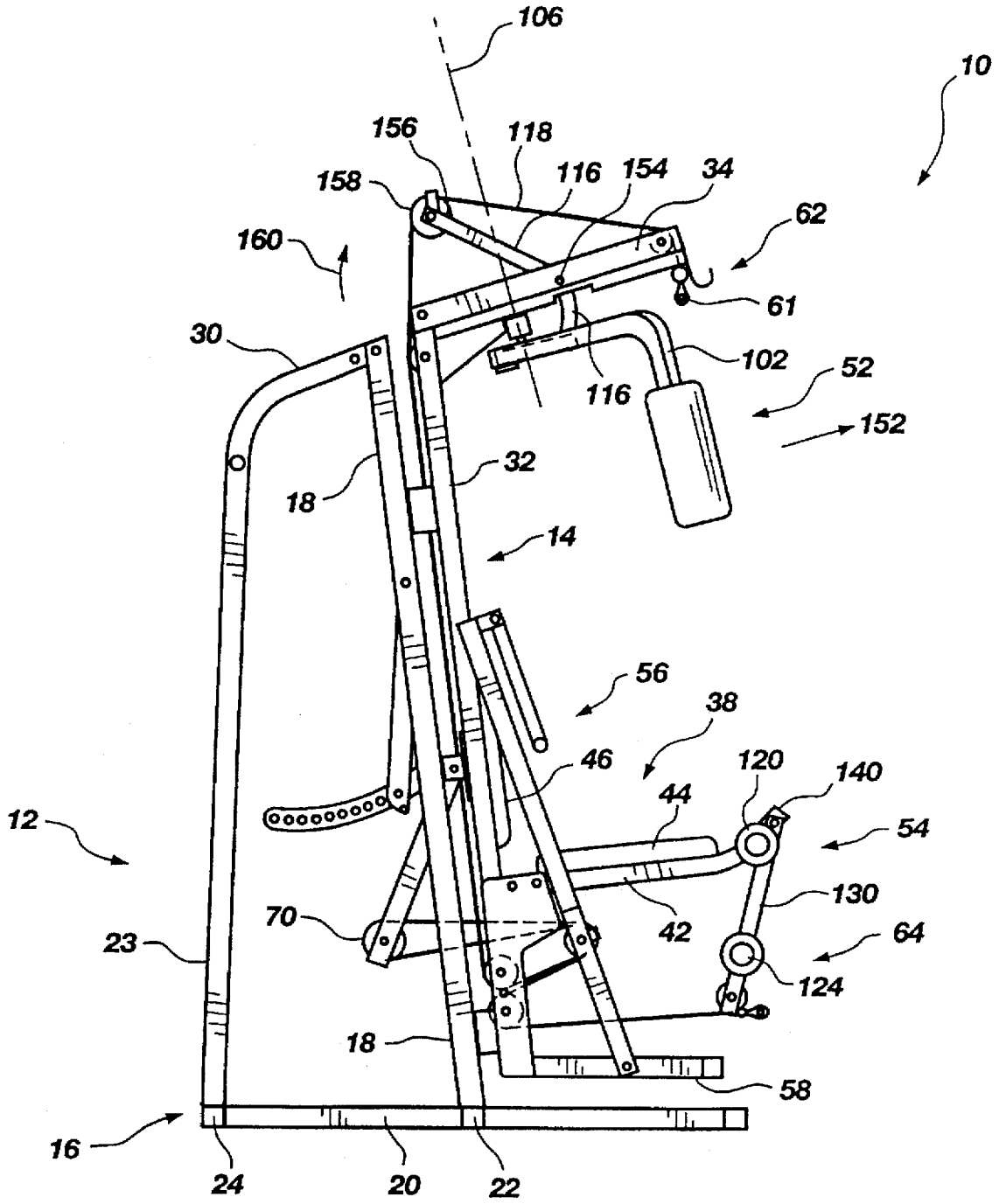
FIG. 4 shows the exercise machine of FIG. 1 with a butterfly arm rotated from an at rest position to a second position.

Referring now to FIG. 4, the butterfly structure 52 is shown in a displaced position relative to the at rest position shown in FIGS. 1, 2 and 3. That is, the right butterfly arm 102 is rotated in an outward direction 152 by a user positioned on the user support means and more specifically seat 44. Outward movement of the right butterfly arm 102 causes the butterfly lever 116 to rotate about a butterfly lever axle 154 to, in turn, cause the distal end 156 of the butterfly lever 116, and more particularly a butterfly lever guide 158 associated therewith to rotate relative to the second frame 14 and more particularly the upper cantilever member 34. As here shown, the butterfly lever 116 and more particularly, the distal end 156 of the butterfly lever 116 rotates in an upward direction 160 from the upper cantilever member 34. In turn, the cable 118 is displaced in turn, causing the first lower guide 184 (FIG. 5) to be displaced and in turn, urging the second frame 14 upward relative to the upright member 18 of the frame 12.

Figure 5:
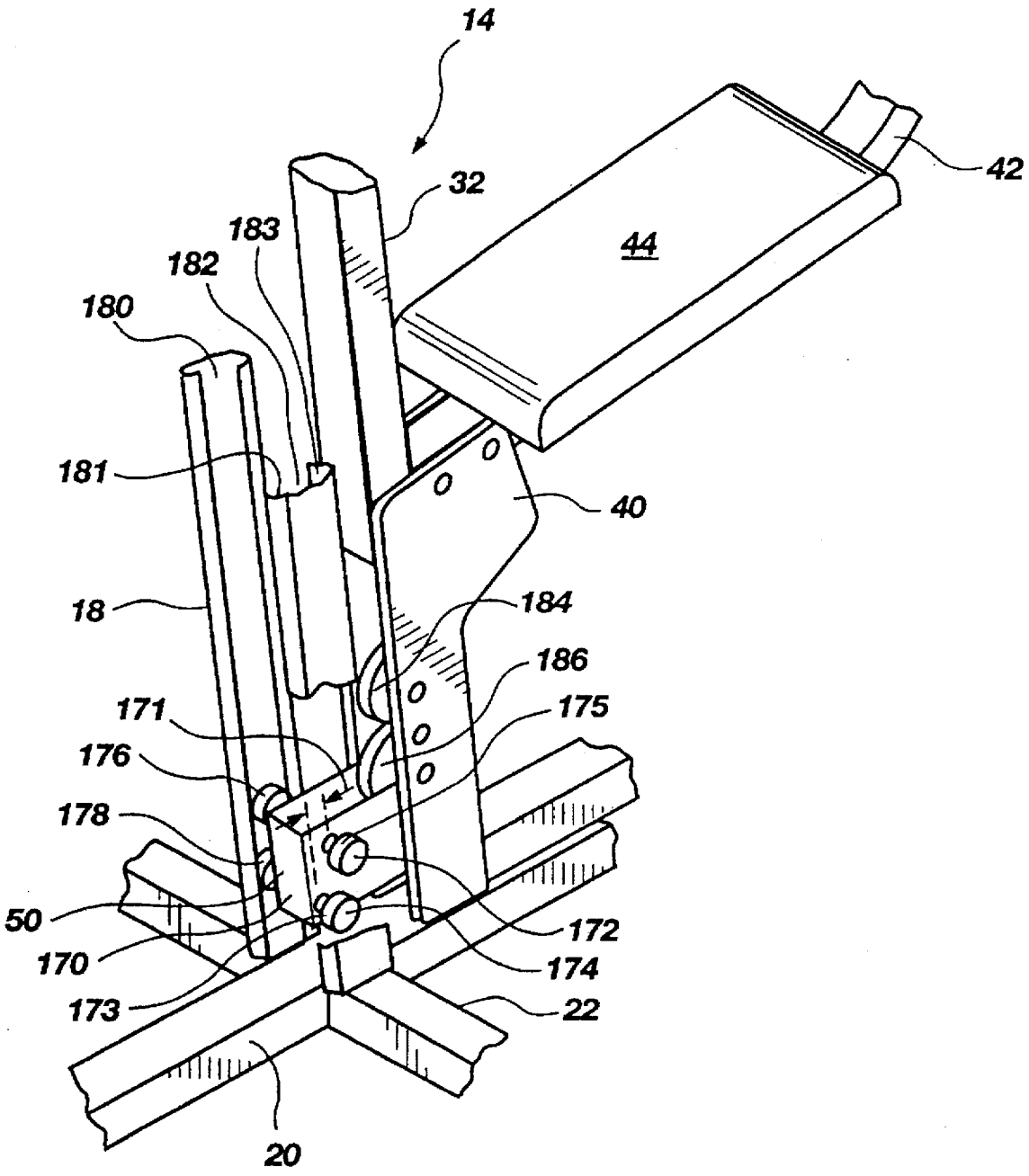
FIG. 5 shows a perspective cut-away portion of the first frame and second frame of the exercise machine of FIG. 1.

Turning now to FIG. 5, a portion of the structure of FIGS. 1 through 4 is shown in perspective and partial cut-away. More particularly, the seat 44 shown connected to the user support extension 42 which is in turn connected to the bracket 40. The bracket 40 is connected to the upright 32 of the second frame 14. The second guide assembly 50 is here shown comprised of a trolley 170 having a plurality of rollers and more particularly, four rollers 172, 174, 176 and 178 positioned for interconnection with the upright member 18. As here shown the upright member 18 is formed into a track to interconnect with the rollers 172, 174, 176 and 178. As here shown, the upright member 18 has a first race 180 and a second race 182 sized to movably receive the rollers 172, 174, 176 and 178 which are wheels rotatably and movably positioned there within. The races 180 and 182 are C-shaped in section as shown to receive and retain the wheels 172, 174, 176 and 178. The wheels 174 and 172 are here shown displaced horizontally a distance 171 so that the perimeter 173 and 175 of each wheel contacts different surfaces 181 and 183 of the associated second race 182. The trolley 170 is thus more stably supported to reduce binding of the trolley 170 as it moves along the upright member 18. A similar configuration is not illustrated for the first guide assembly 48.

Figure 6:
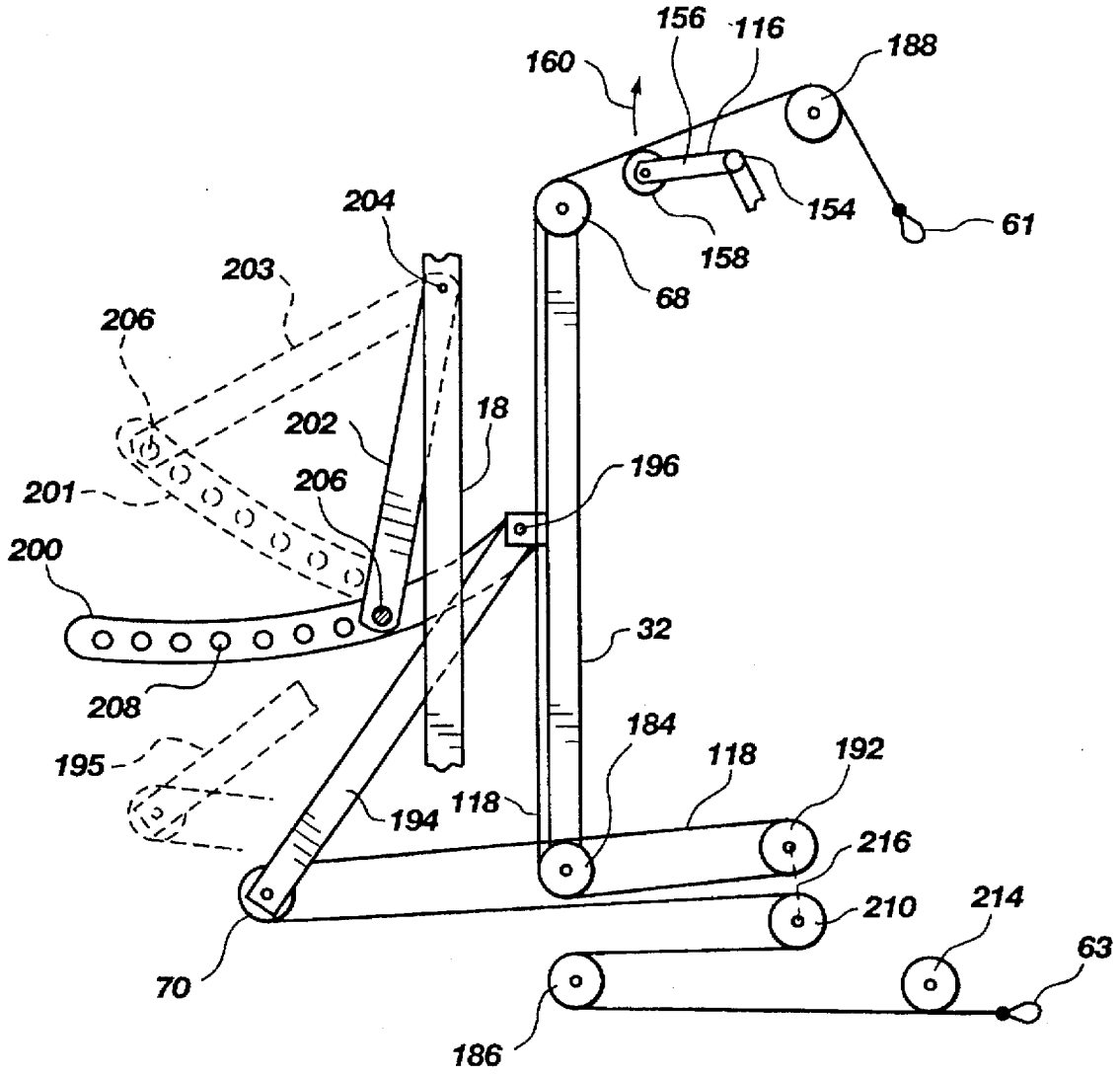
FIG. 6 is a schematic illustration of the cable system and adjustment system of the exercise machine of FIG. 1.
Figure 7:
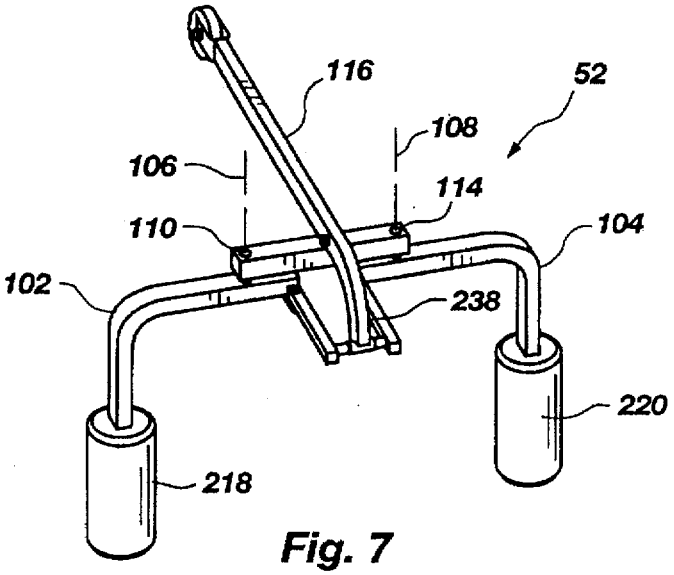
FIG. 7 is a perspective view of a butterfly system for use with the exercise machine of FIG. 1.
Figure 9:
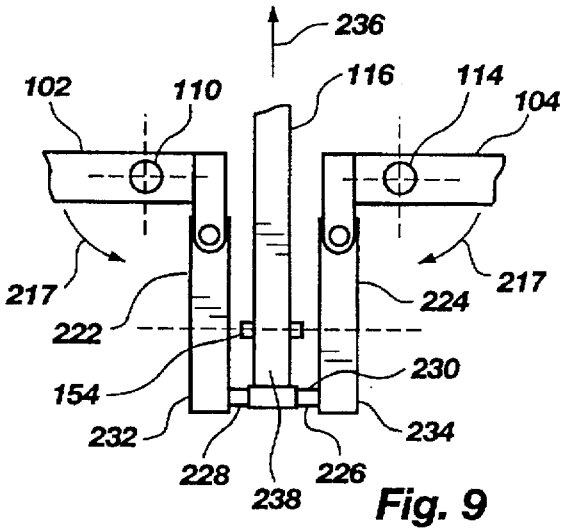
FIG. 9 is a top plan view of portions of the butterfly structure of FIG. 7.

FIG. 5 also shows a first lower guide 184 and a second lower guide 186 each rotatably connected to the bracket 40 to guide the cable 118 thereabout. More specifically, the linking means is generally illustrated in FIG. 6 to be comprised of a cable 118 and a second guide system including upper guide 68 and a first guide 70. The second guide system also includes primary guide 188 positioned proximate the distal end 150 of the upper cantilever member 34 to guide the cable 118 towards the overhead pull structure and more particularly the first hook 61. The butterfly lever guide 158 positioned at the distal end 156 of the butterfly lever 116 is also shown positioned proximate the cable 118. Upon rotation of the butterfly lever 116, the butterfly lever guide 158 displaces the cable 118 in the upward direction 160 to in turn cause further displacement of the first lower guide 184 as may be apparent from the schematic of FIG. 6.

The first lower guide 184 is provided to guide the cable 118 toward a first press arm guide 192. The cable 118 then proceeds from the press arm guide 192 toward the first guide 70 which is connected to lever 194. The lever 194 is rotatably connected about a lever axle 196 (or the like) which is further connected to the upright member 18. The lever 194 is here interconnected by the lever axle 196 to an arcuate adjustment member 200.

A second lever 202 is rotatably connected to rotate around second lever axle 204 (or the like) connected to the upright member 18. The second lever 202 may be connected via a spring loaded locking pin 206 in any of a plurality of apertures 208 located along the length of the adjustment member 200. In turn, the relative relationship of the first guide 70 relative to the first frame 12 and the second frame 14 is adjusted to in turn vary the purchase or the mechanical advantage and in turn the amount of resistance experienced by the user when operating the operation means while seated on the user support 38.

As herein before stated, the cable 118 is trained around the first guide 70. It extends to a second press arm guide 210 and further around a lower guide 186 for extension to the extension guide 214.

In FIG. 6, the guides 210 and 192 are shown displaced. However, the guides 210 and 192 are preferably positioned on the same guide axle 216 (or the like) for convenience and to facilitate operation of the press arm structure 56.

As also seen in FIG. 6, the second lever 202 can be moved along the length of the adjustment member 200 to its outer position as shown in phantom 203 and 201, respectively. In turn, the lever 194 is moved to a second position also shown in phantom 195. The relative relationship as herein before stated varies the mechanical advantage or mechanical disadvantage to in turn vary the resistance experienced by the user positioned on the seat 44 while operating the operation means of the exercise machine 10.

It may be noted that the guides 68, 70, 158, 184, 186, 188, 192, 210 and 214 are here shown and preferred to be pulleys configured to receive a cable in an appropriate track or indentation in the outer rim thereof. The guides are mounted by axles, pins, shafts or the like so they may support the forces applied and rotate if desired.

Referring now to FIGS. 7 through 10, butterfly structure 52 of FIG. 1 is illustrated in more detail. More specifically the right butterfly arm 102 and the left butterfly arm 104 are shown positioned to rotate about substantially upright axes 106 and 108, respectively. In turn, they rotate about axles 110 and 114 (or the like) as they are displaced from the at rest position shown in FIGS. 7 and 9 by rotation 217 when the user places his or her arms about a right cushion 218 and a left cushion 220, respectively. The upright axes 106 and 108 are here shown in axial alignment with the upright member 18. However, the upright axes 106 and 108 may be oriented relative to the vertical at any angle so that the butterfly arms 102 and 104 may be suitably oriented for performing butterfly exercises.

A first link 222 and a second link 224 interconnect to a cross link 226. The cross link 226 has outer ends 228 and 230 rotatably interconnected into the distal ends 232 and 234 of the links 222 and 224, respectively. As the butterfly arms 102 and 104 rotate along rotation 217, the links 222 and 224 move in rearward direction 236 to, in turn, cause the cross link 226 to urge the butterfly lever 116 and more particularly the proximal end 238 of the butterfly lever member 116 in rearward direction 236.

Figure 8:
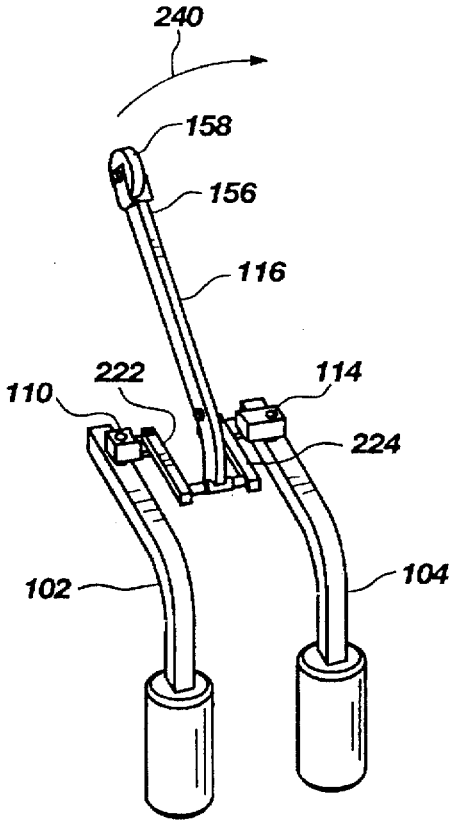
FIG. 8 is a perspective view of the butterfly system of FIG. 7 positioned in a second position.
Figure 10:
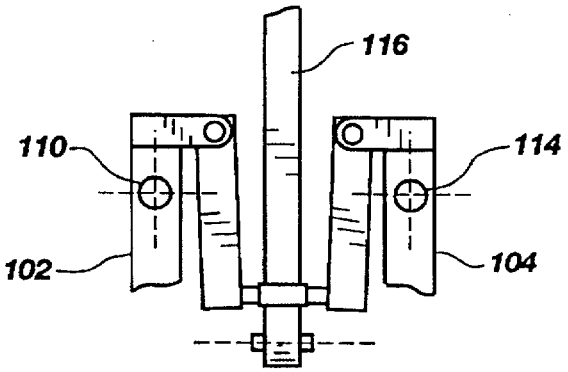
FIG. 10 is a partial top plan view of the butterfly structure illustrated in FIG. 8.

As better seen in FIGS. 8 and 10, rearward movement of the links 222 and 224 urges the proximal end 238 of the butterfly lever member 116 rearward and in turn, causes the distal end 156 of the butterfly lever 116 and the butterfly lever guide 158 positioned proximate thereto in upward direction 240 to in turn displace the cable 118 as earlier described.

With the linkage of FIGS. 7 through 10, a single cable 118 may be used without providing for additional cable connections to separate butterfly arms. In turn, a single cable 118 may be used without providing for wire corrections or other complicated structure. At the same time, the cable 118 may continue on for connection to other operating structure. Further, the size of the links 222 and 224 as well as the butterfly arms 102 and 104 may be varied to regulate the mechanical advantage and further the displacement of the cable 118.

Figure 11:
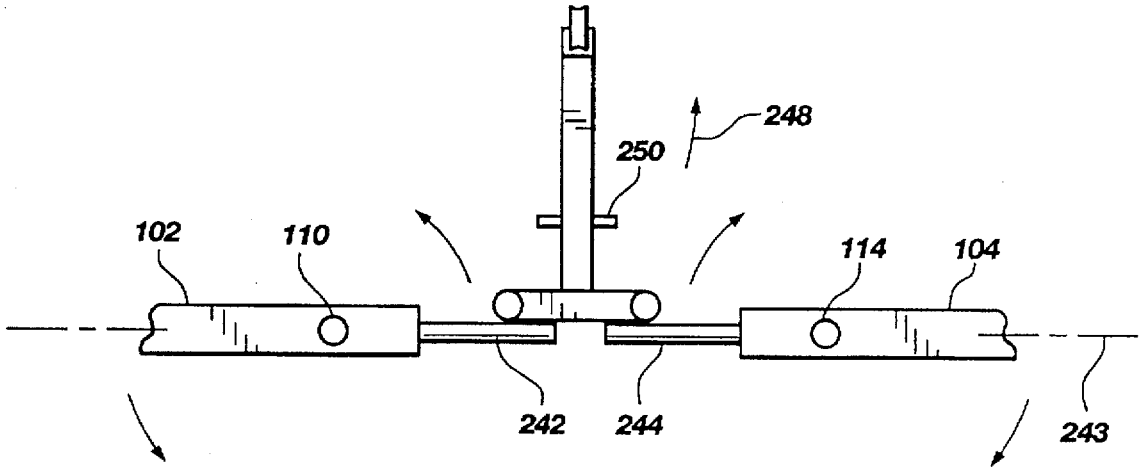
FIG. 11 is a partial top plan view of alternate butterfly structure for use in the exercise machine of FIG. 1.
Figure 12:
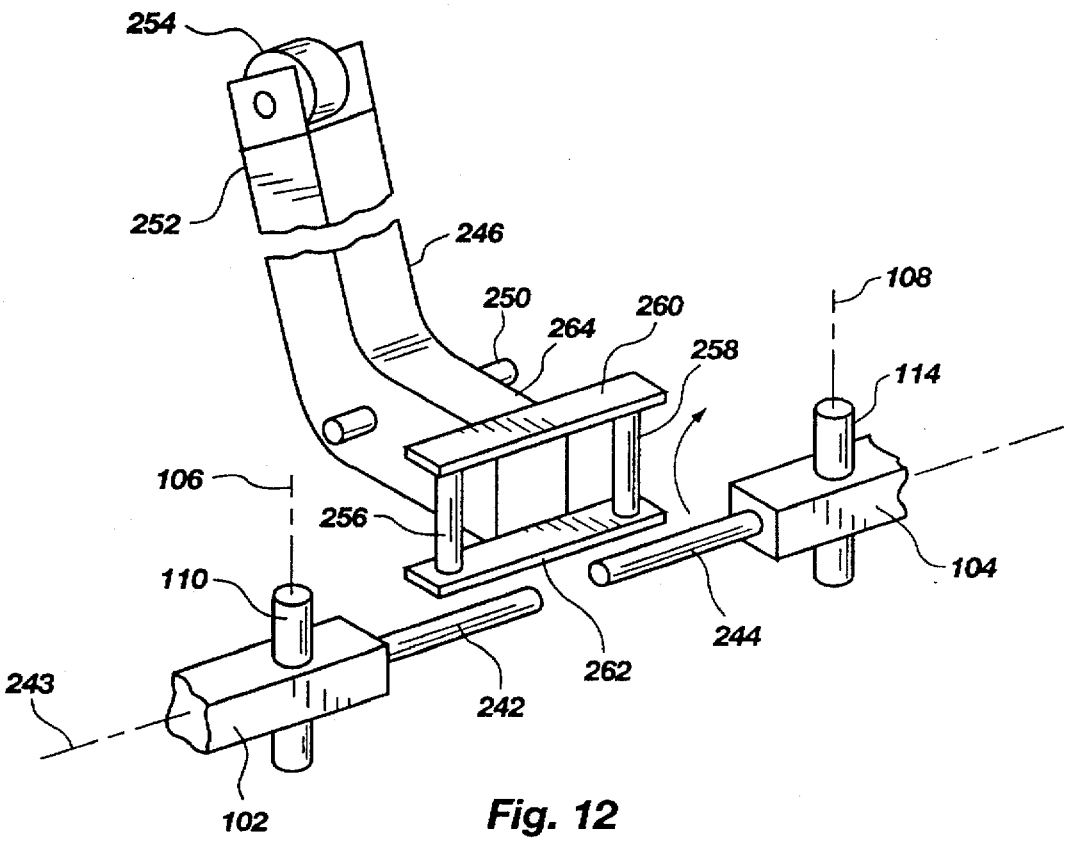
FIG. 12 is a perspective broke-away partial view of a butterfly structure for an alternate butterfly structure of FIG. 11 for use in the exercise machine of FIG. 1.

An alternate butterfly structure is shown in FIGS. 11 and 12. More specifically, the butterfly arms 102 and 104 each have a first extension 242 and a second extension 244, respectively, connected to extend away therefrom in a general axial direction 243 as shown in FIG. 11. A butterfly lever 246 is shown having a surface against which the extensions 242 and 244 are in contact. Therefore upon rotation of the butterfly arms 102 and 104 about their respective axles 110 and 114, the surface is urged in rearward direction 248 to in turn cause the butterfly lever 246 to rotate about butterfly lever axle 250. Rotation about the butterfly lever axle 250 (or the like) in turn causes the distal end 252 of the butterfly lever 246 to rotate relative to the frame, in turn, causing a butterfly lever guide 254 positioned proximate the distal end 252 to displace the cable 118 trained about the butterfly lever guide 254. As better seen in FIG. 12, the surface for contact by the extension 242 and 244 is preferably comprised of a right cylinder 256 and a left cylinder 258 positioned between an upper plate 260 and a lower plate 262. The cylinders 256 and 258 are sized to extend between the plates 260 and 262 to provide for full motion of the proximal end 264 of the butterfly lever 246 as it rotates about the butterfly lever axle 250. As seen in FIG. 12, the extensions 242 and 244 as well as the cylinders 256 and 258 are in fact formed to be substantially cylindrical in cross section and formed of a low friction metal to provide for ease in operation and to avoid binding or other restrictions. It may be further noted that in the configuration of FIG. 12, one butterfly arm may be operated separate and apart from the other to in turn provide the user with other exercise options in performing butterfly exercises. It may also be noted that the cylinders 256 and 258 as well as the extensions 242 and 244 may be made of any convenient geometrical shape to effect a sliding relationship.

Figure 13:
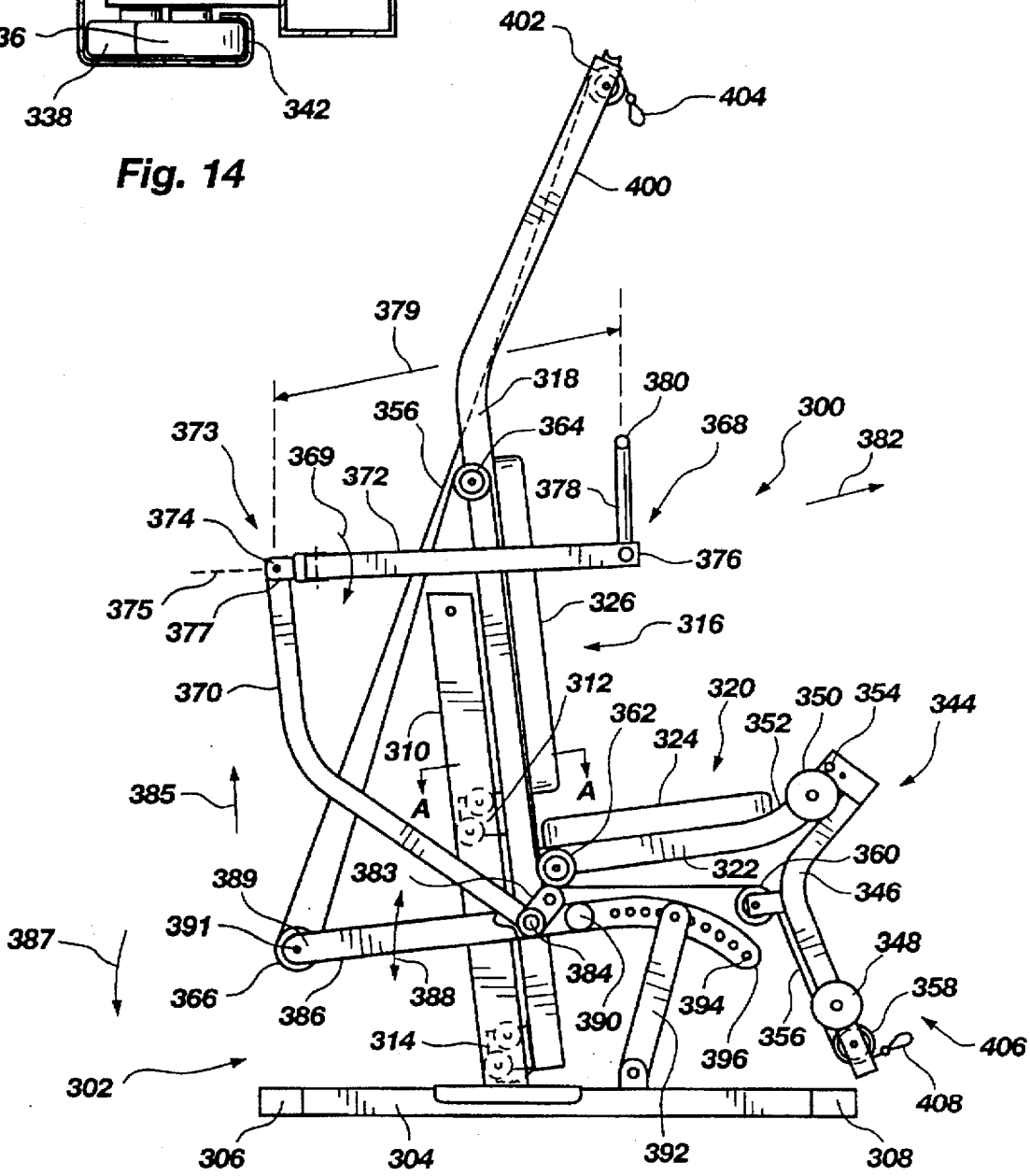
FIG. 13 shows an alternate exercise machine of the invention having a second frame moveable relative to a first frame.

Referring now to FIG. 13, an alternate configuration of an exercise machine of the invention 300 is shown having a first frame 302 that includes a base 304. The base 304 has a rear cross member 306 and a forward cross member 308 attached to provide a stable footprint to support the exercise machine 300 on a support surface. The first frame 302 includes an upright member 310 connected to the base 304 to extend upwardly therefrom in a manner similar to the upright member 18 associated with the base 16 with FIG. 1. Similarly, an upper guide structure 312 and a lower guide structure 314 are provided to guide a second frame 316 for movement relative to the upright member 310 of the first frame 302.

The second frame 316 as here illustrated has an upright 318 with a user support structure 320 comprised of a user support member 322 and a seat 324 connected thereto. The user support structure 320 also includes a back 326 connected to the upright 318 of the second frame 316.

Figure 14:
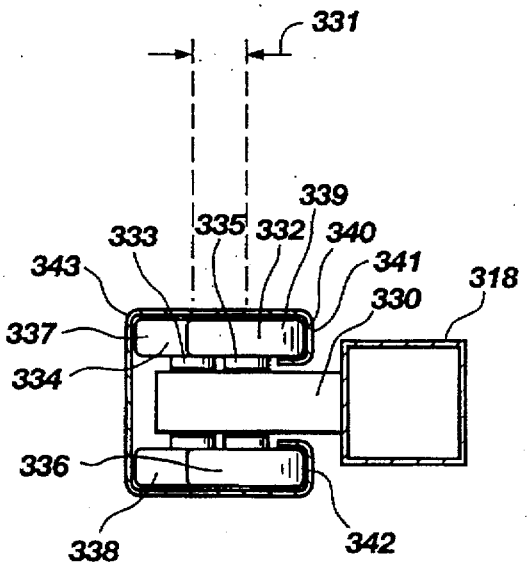
FIG. 14 is a cross sectional view of a portion of the frame of the exercise machine of FIG. 13.

As better seen in FIG. 14, the guide structures 312 and 314 are shown to be comprised of a trolley 330 interconnected to the upright 318 of the second frame 316. The trolley 330 has a plurality of wheels 332, 334, 336 and 338 interconnected to move in the race 340 and 342 of the upright member 310 of the first frame 302. As may be noted, the race 340 and 342 are generally C-shaped in section to retain the wheels 332, 334, 336 and 338 therewithin during operation. The wheels 332 and 334 are rotatably mounted to the trolley 330 by axles 333 and 335 that are horizontally displaced a distance 331 so that the outer perimeters 337, 339 of each wheel contacts a different surface 341, 343 of the race 340. Wheels 338 and 336 are similarly configured.

The machine 300 of FIG. 13 has an extension structure 344 here comprised of a lower extension 346 having lower cushion 348. An upper cushion 350 is attached to user support member 322 to contact the rear of the knee of a user on seat 324. The lower cushion 348 is connected proximate the distal end of the lower extension 346. The upper cushion 350 is positioned proximate the distal end 352 of the user support member 322. The extension 346 is positioned to rotate about a lower extension axle 354 (or the like) positioned proximate the distal end 352 of the member 322. A cable 356 is trained around a lower guide 358 as well as an extension guide 360, a lower frame guide 362 and an upper frame guide 364 for interconnection to a first guide 366 as more fully discussed hereinafter.

The machine 300 also has a press arm structure 368 which includes a right lever 370 and a left lever not shown. The right lever 370 has a right extension 372 rotatably connected thereto by a universal joint 373 at a right extension axle 374

(or the like). The universal joint has a yoke 377 connected to the right extension axle 374 and a sleeve or axle so the right extension 372 may also rotate in direction 369 about its axis 375. The right extension 372 is selected to have a length 379 so it is positioned proximate a user on the seat 324. Proximate the distal end 376 of the right extension 372 is a floating arm 378 with a cross handle 380 similar to the right cross handle 92 of FIG. 1.

In operation, the user may urge the right cross handle 380 in a forward direction 382 in turn causing the right lever 370 and the left lever (not shown) to rotate around lever axle 384. In turn, a second extension 383 rotates clockwise toward a stop 390. As the second extension 383 contacts the stop 390, the force exerted by the user on the right cross handle 380 is transmitted to urge the lever axle 384 in an upward direction 385 in turn causing the upright 318 to move upwardly against the weight of the user positioned on seat 324.

As the upright 318 moves in an upward direction 385, a lever 386 also rotates counterclockwise about lever axle 384. In turn the cable 356 remains generally taut so that a first connector 404 (and bar 60 if attached) does not move downwardly and interfere with the user on the seat 324. That is the lever 386 rotates in a generally downward direction 387 as the upright 318 moves in the upward direction 385. The downward direction 387 movement of the lever 386 is encouraged by placing weights proximate the outer or distal end 389 of the lever 386. In the embodiment of FIG. 13, the weights are round discs (not shown) mounted coaxially on a first guide axle 391 with first guide 366. First guide 366 is a pulley with a notch or track sized to receive the cable 356 about its perimeter. The mechanical advantage or the purchase may be varied by moving a selector arm 392 to any one of the plurality of apertures 394 formed in an adjustment lever 396. That is, the user may select the degree of difficulty by moving the selector arm 392 from a position close to the stop 390 to a position at the distal end of the adjustment lever 396. The selector arm 392 is preferably secured in place by a locking pin or the like. Virtually any securing arrangement is sufficient so long as it prevents relative movement.

Figure 20:
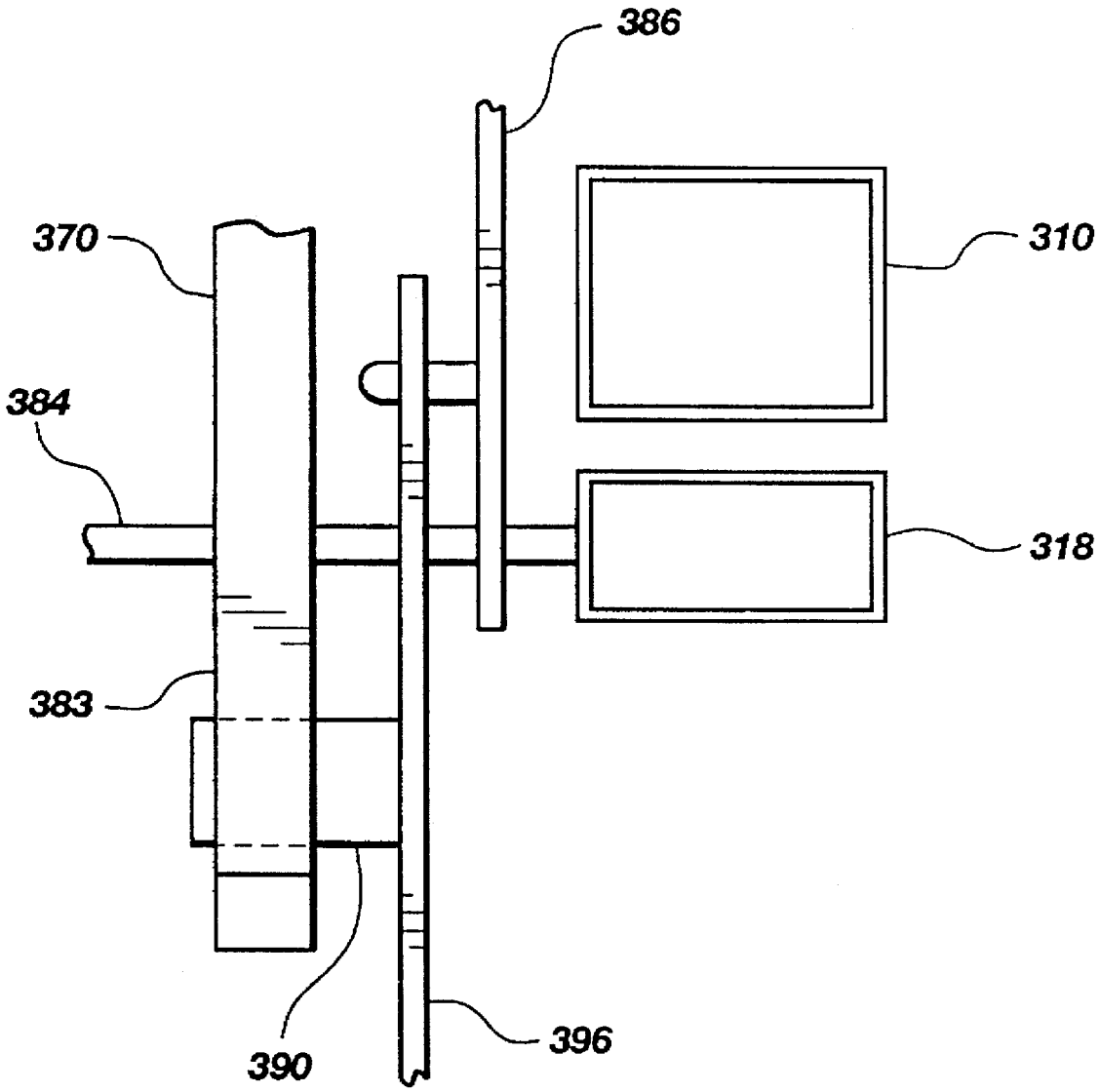
FIG. 20 is a simplified top plan view of selected portions of a cross section of the machine of FIG. 13.
Figure 21:
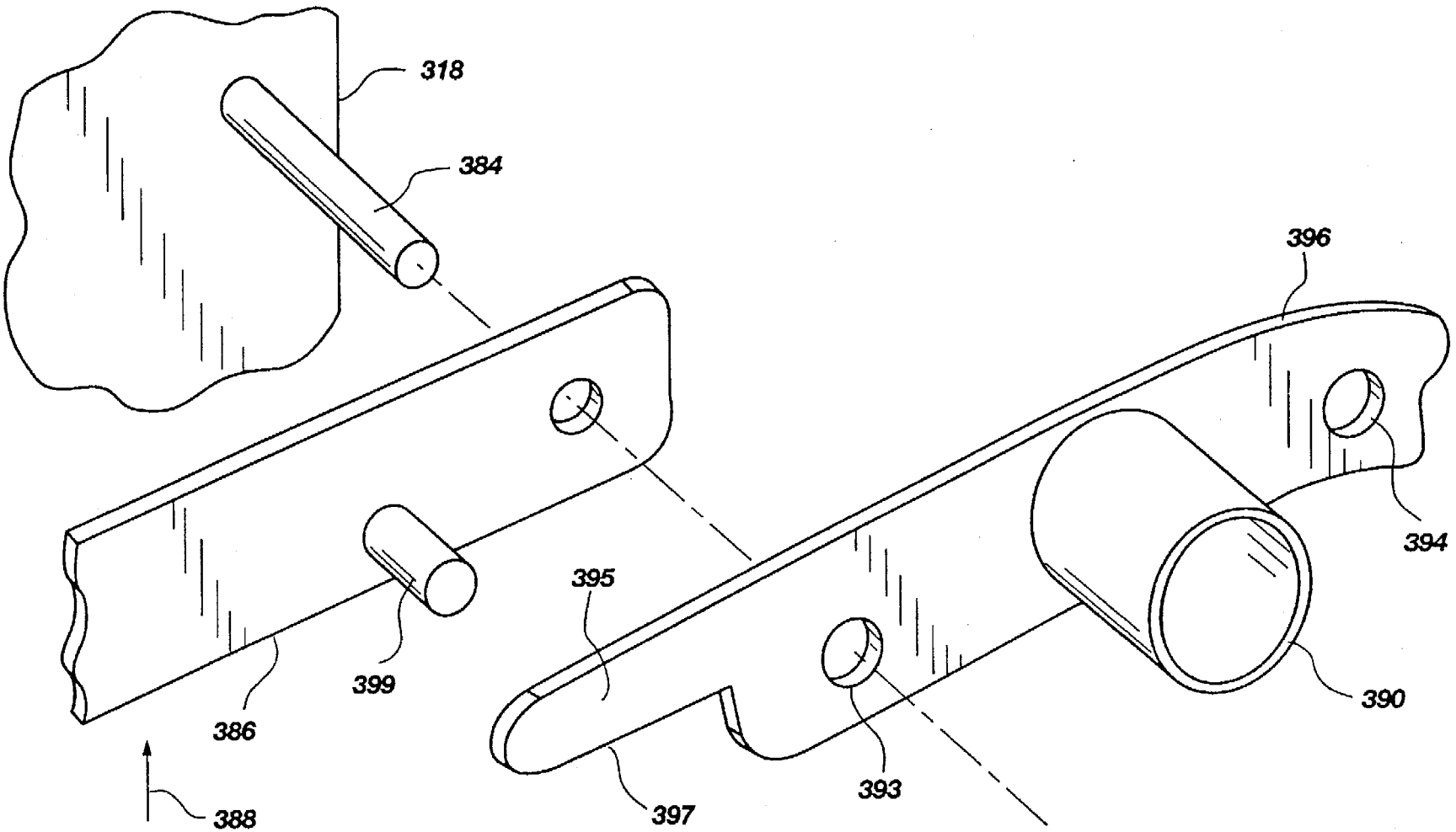
FIG. 21 is a partial perspective exploded view of selected components of the machine of FIG. 13.

As better seen in FIGS. 20 and 21, the adjustment lever 396 has a first aperture 393 to receive lever axle 384. The adjustment lever 396 rotates clockwise about the lever axle 384 as the upright 318 moves upward upon movement of the right lever 370 by the user. The adjustment lever 396 is formed to have a finger 395 formed with a shoulder 397 for contact with an actuating finger 399. That is, movement of cable 356 such as by movement of the first connector 404, a second connector 408 or the extension structure 344 all tensionally transmit a force to the first guide 366 to in turn urge the lever 386 in an upward direction 388. In turn, the actuating finger 399 engages the shoulder 397 of the finger 395 to urge the upright 318 upward by applying the force through lever axle 384 to the upright 318. Here again the purchase or mechanical advantage can be varied by moving the location of the selector arm 392 which is locked into position by a bolt, spring loaded locking pin or the link.

In reference to FIGS. 20 and 21, it should be noted that various washers, locking bolts, nuts and the like have not be shown and are not being described for purposes of clarity and brevity. Those skilled in the art will understand the need for such components.

The machine 300 of FIG. 13 also has an overhead bar structure provided by a third extension 400 of the upright 318. The cable 356 extends around an upper guide 402 to the first connector 404 provided for interconnection to a bar such as bar 60 shown in FIG. 1. Similarly, a curl structure 406 is provided by the second connector 408 for further connection to an eye or the like 134 of a bar 60 such as that shown in FIG. 1. The overhead pull and curl structures operate in a manner similar to that described regarding FIGS. 1–4.

Figure 15B:
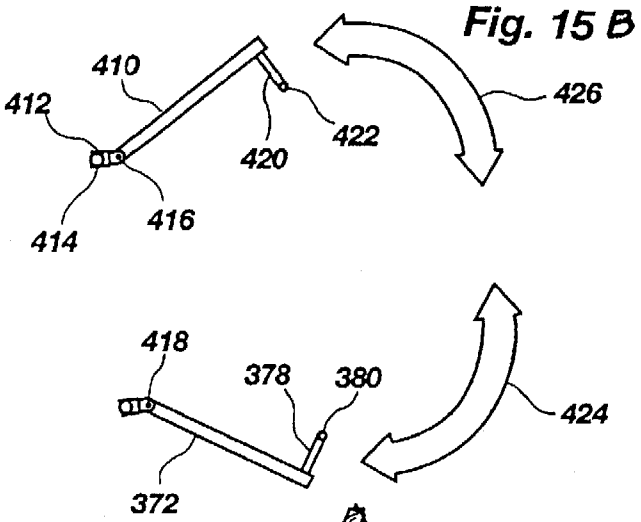
FIG. 15B is a partial top plan view of the exercise machine of FIG. 15A.
Figure 15A:
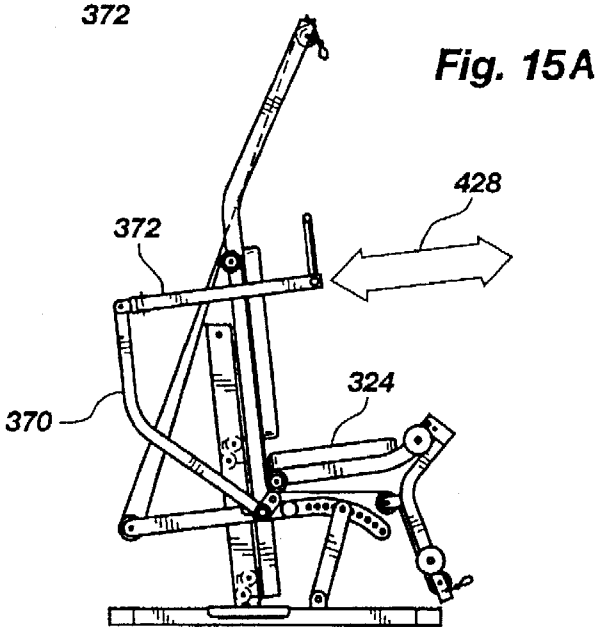
FIG. 15A illustrates a side view of the exercise machine of FIG. 13 for use in performance of a press exercise.

FIG. 15 shows the exercise machine of FIG. 13 configured for use in performing "crossover fly" type exercises. The right extension 372 is configured with a corresponding left extension 410 which is similarly connected about a second axis 412 to a left lever 414 and also for rotation about a third axis 416 similar to a fourth axis 418 for the right extension 372. The floating arm 378 and a comparable floating arm 420 are provided with a left cross handle 422 and a right cross handle 380 for grasping by the user. The user seated on the seat 324 may then operate the extensions 372 and 410 by moving the handles 380 and 422 as shown by the arrows 424 and 426 simultaneously with movement as shown with the arrow 428. In turn, the left lever 414 and the right lever 370 are displaced to in turn cause displacement of the first guide 366 and in turn urge movement of the second frame 316 relative to the upright member 310 of the first frame 302.

Figure 16B:
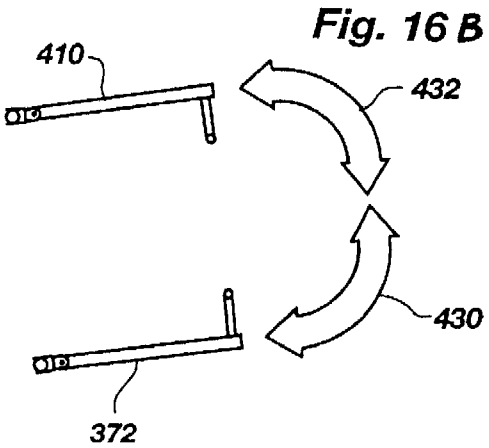
FIG. 16B is a partial top view of the exercise machine of FIG. 16A.
Figure 16A:
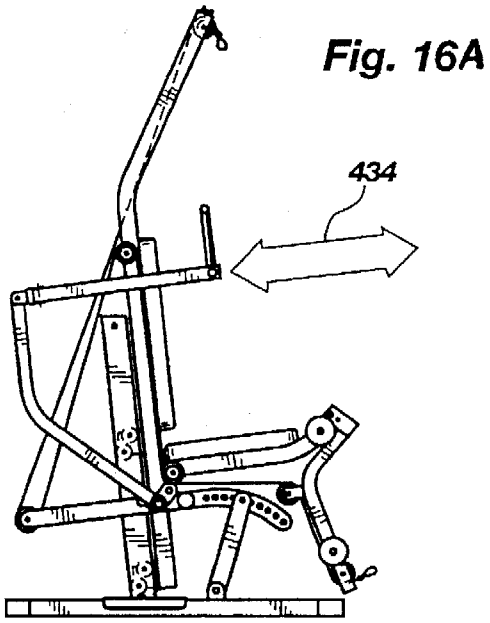
FIG. 16A illustrates a side view of the exercise machine of FIG. 1 and in the performance of a butterfly-type exercise.

In FIG. 16, the right extension 372 and the left extension 410 are shown configured for performance of a butterfly exercise in which the extensions 372 and 410 are urged forwardly and arcuately inwardly as shown by the arrows 430 and 432 as well as arrow 434.

Figure 17:
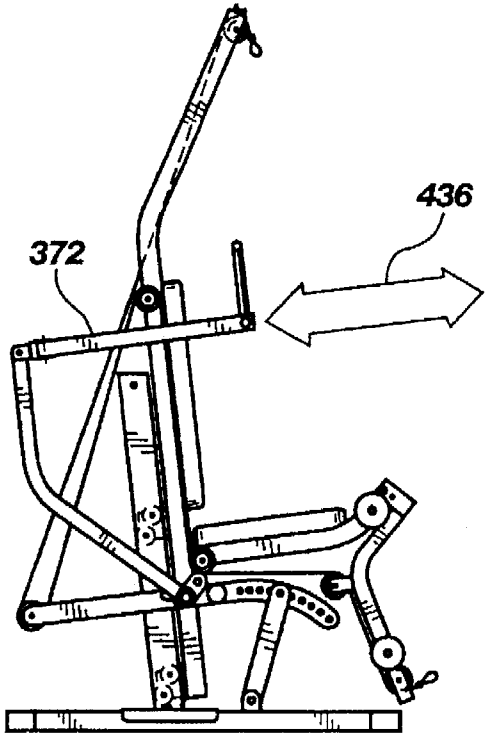
FIG. 17 shows the exercise machine of FIG. 13 for performance of a bench press-type exercise.

FIG. 17 shows a machine of FIG. 13 configured for performing a bench press exercise as depicted by the arrow 436.

Figure 18:
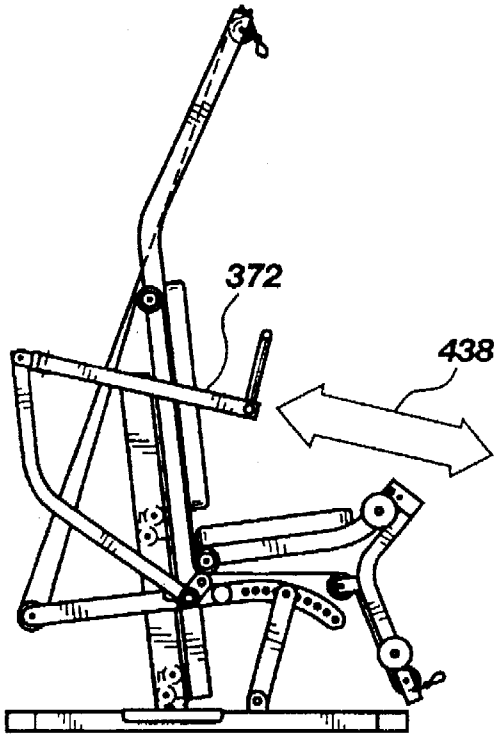
FIG. 18 shows the exercise machine of FIG. 13 configured for performance of a decline press-type exercise.

FIG. 18 shows the machine of FIG. 13 configured for performance of decline press exercises upon movement of right extension 372 and the left extension 410 in a direction shown by the arrow 438.

Figure 19:
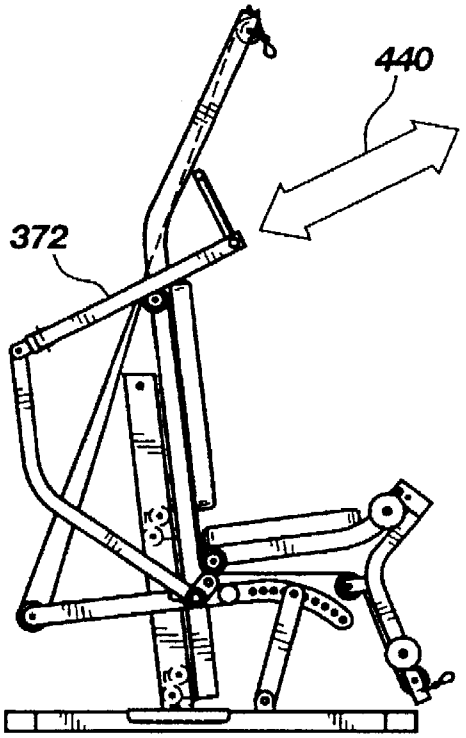
FIG. 19 shows the exercise machine of FIG. 13 configured for the performance of incline press-type exercise.

FIG. 19 shows the machine of FIG. 13 configured for performance of incline press exercises. The right extension 372 and the left extension 410 are configured for operation and movement in the direction of the arrow 440.

It should be understood that the description of the above-referenced embodiments is not intended to limit the scope of the claims which themselves recite those features which are regarded as essential to the invention.

What is claimed is:

1. An exercise machine comprising:

a first frame having a base for positioning on a support surface, said first frame including an upright member secured to said base to extend upwardly therefrom;

a second frame positioned proximate said upright member for movement relative thereto and therealong;

a first guide assembly and a second guide assembly spaced apart from each other and positioned one above the other, said first guide assembly and said second guide assembly each interconnecting said second frame and said upright member for guiding said second frame in moving substantially linearly upwardly and downwardly relative to said upright member;

a user support secured to said second frame to support a sitting user thereon;

operation means connected to one of said first frame and said second frame and positioned for operation by a user positioned on said user support to perform exercises; and linking means interconnecting said operation means to said first frame and to said second frame to urge movement of said second frame upward relative to and along said upright member upon operation of said operation means by a user against the weight of the said second frame and the weight of a user positioned on said user support, said linking means including a lever mechanism movably connected to said first frame and a guide connected to said second frame spaced from said lever mechanism; and a cable associated with said lever mechanism and trained about said guide, said cable being connected to said operations means and to said linking means to urge said second frame to move relative to said first frame upon operation of said operation means by a user.

2. The exercise machine of claim 1, wherein said first guide assembly is a first trolley with a first roller rotatably attached thereto and wherein said first roller guides said second frame in moving relative to and along said upright member.

3. The exercise machine of claim 2, wherein said second guide assembly is a second trolley with a second roller rotatably attached thereto and wherein said second roller guides said second frame in moving relative to and along said upright member.

4. The exercise machine of claim 3, wherein said upright member includes a track configured for contact by said first roller and said second roller.

5. The exercise machine of claim 4, wherein said track has a first race and a second race sized to movably receive said first roller and said second roller therewithin.

6. The exercise machine of claim 5, wherein said first roller and said second roller are each a pair of spaced apart wheels.

7. The exercise machine of claim 6, wherein second frame includes an upright in general alignment with and spaced from said upright member.

8. The exercise machine of claim 7, wherein said user support is a seat attached to said upright to receive and support a sitting user thereon.

9. The exercise machine of claim 8, wherein said user support includes a back rest attached to said upright above said seat.

10. The exercise machine of claim 8, wherein said operation means includes a press arm having a left member and a right member.

11. The exercise machine of claim 10, wherein said operation means includes an extension structure positioned proximate said seat for operation by a user seated thereon to perform leg exercises.

12. The exercise machine of claim 11, wherein said operation means includes butterfly exercise structure positioned for operation by a user on said seat to perform butterfly exercises.

13. The exercise machine of claim 12, wherein said operation means includes overhead pull structure for performing overhead pull exercises.

14. The exercise machine of claim 13, wherein said left member and said right member of said press arm each include a handle movably attached thereto proximate their respective distal ends.

15. The exercise machine of claim 13, wherein said operation means includes a lower curl structure for operation by a user on said seat in performing curl exercises.

16. The exercise machine of claim 12, wherein said butterfly structure includes a left butterfly arm and a right butterfly arm each rotatably attached to said second frame for rotation about a generally upright axis.

17. The exercise machine of claim 16, wherein said butterfly structure includes a butterfly lever arm rotatably connected to said second frame to rotate toward and away therefrom and linkage for engaging said linking means and interconnecting said left butterfly arm and said right butterfly arm to said butterfly lever arm.

18. The exercise machine of claim 17, wherein said butterfly lever arm has a proximal end positioned proximate a proximal end of said left butterfly arm and a proximal end of said right butterfly arm and wherein said proximal end of said butterfly lever arm has a guide surface and wherein said left butterfly arm has an extension to contact said guide surface to urge said guide surface and said proximal end of said butterfly lever arm to move relative to said second frame.

19. The exercise machine of claim 18, wherein said right butterfly arm has an extension to contact said guide surface to urge said guide surface and said proximal end of said butterfly lever arm to move relative to said second frame.

20. The exercise machine of claim 18 wherein said butterfly lever arm has a butterfly guide on its distal end, wherein said cable is trained over said butterfly guide.

21. The exercise machine of claim 1, further including a first lever member rotatably connected to said second frame to rotate about an axle, said lever member having a first end positioned away from said axle with a lever guide positioned thereon, said cable being trained over said lever guide.

22. The exercise machine of claim 21, wherein said lever mechanism includes an adjustment lever rotatably attached to said second frame and a second lever rotatably attached to said first frame for removable connection to said adjustment lever member at a plurality of positions.

23. The exercise machine of claim 22, wherein said adjustment lever is arcuate in shape with a plurality of apertures formed therein along its length; and wherein said second lever has a pin to secure said second lever to any of said plurality of apertures.

24. The exercise machine of claim 23, wherein said first lever is secured to an upright on said second frame in general alignment with and spaced from said upright member and said second lever is secured to said base.

25. The exercise machine of claim 21, wherein said first lever member has a second end spaced away from said axle, and wherein said lever mechanism includes an arm rotatably connected to said first frame at one end and configured for attachment to said lever member.

26. An exercise machine comprising:

a first frame having a base for positioning on a support surface, said first frame including an upright member secured to said base to extend upwardly therefrom;

a second frame positioned proximate said upright member for movement relative thereto and therealong;

a first guide assembly and a second guide assembly spaced apart from each other and positioned one above the other, said first guide assembly and said second guide assembly each interconnecting said second frame and said upright member for guiding said second frame in moving substantially linearly upwardly and downwardly relative to said upright member;

a user support secured to said second frame to support a sitting user thereon;

operation means connected to one of said first frame and said second frame and positioned for operation by a user positioned on said user support to perform exercises; and linking means interconnecting said operation means to said first frame and to said second frame to urge movement of said second frame upward relative to and along said upright member upon operation of said operation means by a user against the weight of the said second frame and the weight of a user positioned on said user support, said linking means including a lever mechanism movably connected to said first frame and a plurality of guides connected to said second frame spaced from said lever mechanism; and a cable associated with said lever mechanism and trained about each guide of said plurality of guides, said cable being connected to said operations means and to said linking means to urge said second frame to move relative to said first frame upon operation of said operation means by a user.

27. An exercise machine comprising:

a frame;

user support means secured to said frame structure to support a user thereon during the performance of exercise;

a left butterfly arm rotatably connected to said frame to rotate about an axis;

a right butterfly arm rotatably connected to said frame to rotate about an axis;

a butterfly lever rotatably connected to said frame having a proximal end positioned proximate said left butterfly arm and said right butterfly arm and a distal end moveable toward and away from said frame;

linkage to link said proximal end of said butterfly lever to said left butterfly arm and said right butterfly arm so that upon movement of either said left butterfly arm or said right butterfly arm said proximal end of said butterfly lever moves and said distal end of said butterfly lever moves; and a cable positioned proximate said distal end of said butterfly lever for displacement upon movement of said butterfly lever.

28. The exercise machine of claim 27, wherein said linkage has a butterfly guide surface associated with the proximal end of said butterfly lever, and wherein said left butterfly arm has an extension at its proximal end for contacting said guide surface.

29. The exercise machine of claim 28, wherein said right butterfly arm has an extension at its proximal end for contacting said guide surface.

30. The exercise machine of claim 29, wherein said guide surface is a left cylinder and a right cylinder spaced from said left cylinder, said left cylinder being positioned for contact with the extension of said left butterfly arm and said right cylinder being positioned for contact with the extension of said right butterfly arm.

* * * * *